US007572001B2

(12) United States Patent
Ito

(10) Patent No.: US 7,572,001 B2
(45) Date of Patent: Aug. 11, 2009

(54) PLATEN MOVING MECHANISM AND THERMAL PRINTER

(75) Inventor: Akihiko Ito, Chiba (JP)

(73) Assignee: Seiko Instruments Inc. (JP)

( * ) Notice: Subject to any disclaimer, the term of this patent is extended or adjusted under 35 U.S.C. 154(b) by 387 days.

(21) Appl. No.: 11/193,839

(22) Filed: Jul. 29, 2005

(65) Prior Publication Data

US 2006/0044379 A1 Mar. 2, 2006

(30) Foreign Application Priority Data

Aug. 24, 2004 (JP) ..... 2004-244059

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS

| | | | | |
|---|---|---|---|---|
| 4,575,729 | A * | 3/1986 | Ayers et al. | 347/49 |
| 4,663,638 | A * | 5/1987 | Hirose | 346/136 |
| 5,139,351 | A * | 8/1992 | Kamada | 400/120.16 |
| 6,155,730 | A * | 12/2000 | Nakayama et al. | 400/613 |
| 6,744,457 | B2 * | 6/2004 | Seino et al. | 347/220 |
| 6,831,670 | B2 * | 12/2004 | Fujiwara | 347/222 |

FOREIGN PATENT DOCUMENTS

| | | |
|---|---|---|
| DE | 3943239 | 6/1991 |
| EP | 0775585 | 11/1996 |
| JP | 06246943 | 9/1994 |

* cited by examiner

*Primary Examiner*—Stephen D Meier
*Assistant Examiner*—Alexander C Witkowski
(74) *Attorney, Agent, or Firm*—Adams & Wilks

(57) ABSTRACT

A platen moving mechanism has a main body frame having a first recess, a head that performs processing on a sheet material, and a platen roller having a shaft portion that is inserted in the first recess of the main body frame while the sheet material is fed in a preselected feeding direction between the platen roller and the head during processing of the sheet material. A platen frame supports the platen roller and is mounted to undergo pivotal movement between an open state and a closed state. The platen frame has a second recess that retains the shaft portion of the platen roller during processing of the sheet material and from which the shaft portion can be completely removed in the open state of the platen frame. A lock arm is mounted to undergo pivotal movement to support the platen roller in the closed state of the platen frame. The lock arm has a third recess in which the shaft portion of the platen roller is inserted in the closed state of the platen frame. During the processing of the sheet material, the platen frame remains in the closed state while the shaft portion of the platen roller is securely retained in the second recess of the platen frame and inserted in the first recess of the main body frame and the third recess of the lock arm.

22 Claims, 4 Drawing Sheets

PLATEN MOVING MECHANISM AND THERMAL PRINTER

BACKGROUND OF THE INVENTION

1. Field of the Invention

The present invention relates to a mechanism capable of moving a platen, which is arranged in close proximity to a head such as a thermal head, so as to separate away from the head, and a thermal printer having the mechanism.

2. Description of the Related Art

Conventionally, in some small thermal printers mounted in, for example, portable information apparatuses, a thermal head and a platen roller are arranged in close proximity to each other, and a sheet material passing through the gap between the two members is heated by the thermal head, thus effecting recording or thermal activation. With this construction, during drive, the platen roller for supporting and conveying the sheet material, and the thermal head that abuts the sheet material to heat the sheet material, are opposed to each other at a small spacing large enough to allow passage of one sheet material therethrough. However, the above construction does not provide a sufficient working space allowing insertion of the operator's hand when, for example, the sheet material jams, when some maintenance is needed on the thermal head or the platen roller, when the sheet material is to be set in position for the first time, etc. In particular, when other various mechanisms, such as a cutter member for cutting the sheet material into an arbitrary length, are arranged in the immediate vicinity of the thermal head and the platen roller to achieve miniaturization, no working space is provided around the thermal head and the platen roller, making it difficult for the operator to directly touch the thermal head and platen roller with his/her hand from any direction during work.

In view of this, JP 2003-200624 A, JP 2002-248820 A, etc. disclose a construction capable of moving the platen roller away from the thermal head. Since a thermal head is often retained inside a casing in order to secure electrical connection for supplying a drive signal, in the construction disclosed, usually a platen roller, which is subject to less constraints than a thermal head, is capable of moving away from a position in close proximity to the thermal head.

In the construction as described in JP 2003-200624 A and JP 2002-248820 A, the platen roller can be removed by releasing a member that holds the platen roller inside the casing of the thermal printer. When the platen roller is thus removed, the front of the thermal head becomes open, thus allowing insertion of the operator's hand to facilitate removal of a jammed sheet material, maintenance on the thermal head, setting of the sheet material in position, etc.

In the construction as described in JP 2003-200624 A and JP 2002-248820 A, the platen roller is removed upward, that is, toward the downstream side in the sheet material passage direction. Accordingly, other components cannot be arranged in close proximity to the thermal head and the platen roller above the thermal head and the platen roller, that is, on the downstream side in the sheet material passage direction. That is, at least, a sufficient space must be secured first to allow the operation of removing the platen roller, and only thereafter, other components can be arranged outside the space. This requirement hinders the overall miniaturization of the apparatus. Further, when, for example, a cutter member for cutting the sheet material into an arbitrary length is to be disposed, the cutter member is located on the downstream side away from the thermal head for effecting recording or thermal activation through the intermediation of a large space secured for the platen roller removing operation, with the result that the sheet material can be cut only at a position spaced at a considerable distance from the heating position, which may result in wastage of the sheet material. To avoid this, a construction may be conceived in which the travelling path of the heated sheet material is changed by bending the same, thus routing the sheet material to a position where it does not obstruct the platen roller removing operation, with a cutter member or the like being disposed so as to cut the sheet material at the position to which it is routed. This construction, however, may lead to an increase in apparatus size or add complexity to the layout of respective components, and further, make smooth conveyance of the sheet material impossible.

The portable apparatus shown in FIG. 7 of JP 2003-200624 A is constructed such that the platen roller can be separated away from the thermal head through rocking motion of the cover member that holds the platen roller, the cover member constituting a part of the casing outer wall. The cover member rocks along a large rocking path. Accordingly, other components cannot be arranged on the downstream side of the thermal head and the platen roller where those components may interfere with the rocking path, making it necessary to adopt a construction in which the heated sheet material is discharged to the outside of the casing as it is. In an alternative conceivable construction, such other components may be arranged on the outer surface of the cover member so that, with the cover member closed, those components exist on the downstream side with respect to the thermal head and the platen roller. However, when the components to be arranged on the outer surface of the cover member are large and heavy, this hinders the rocking motion of the cover member. Further, when a cutter member is to be arranged on the outer surface of the cover member, the cutter member is exposed to the casing exterior, resulting in such disadvantages that the cutter member may cut the operator particularly during the rocking operation, requiring careful handling.

SUMMARY OF THE INVENTION

In view of the above, it is an object of the present invention to provide a platen moving mechanism which is capable of separating a platen away from a head and allows other components to be arranged on the downstream side in the sheet material passage direction in close proximity to the head and the platen, without causing interference with operation by the operator, and to provide a thermal printer having the platen moving mechanism.

A platen moving mechanism according to the present invention includes: a head arranged inside a casing and performing processing on a sheet material passing through the head; a platen for supporting the sheet material, the platen being opposed to the head with the sheet material therebetween during the processing on the sheet material by the head; and a platen frame for holding the platen, the platen frame being opened and closed as the platen frame rocks about a rock shaft to form and block an opening communicating with an inner portion of the casing. During the processing of the sheet material by the head, the platen frame remains closed and forms a part of an exterior of the casing such that the platen is accommodated in the casing. As the platen frame is opened, the platen frame rocks in a direction different from a passage direction of the sheet material such that the platen is drawn out to an outside of the casing. The rock shaft is positioned such that the platen frame does not move toward the passage direction of the sheet material during opening of the platen frame.

With this construction, other components can be arranged on the downstream side in the sheet material passage direction so as to be in close proximity to the head. Accordingly, new processing can be performed on the sheet material immediately after it has undergone the processing by the head, whereby there are relatively little processing constraints and an improved efficiency can be achieved, and further, the efficiency of space utilization is improved to positively contribute toward miniaturization.

It is preferable that the platen moving mechanism further include a switch lever for causing the platen frame to rock, the switch lever having an operation portion that is actuated through operation in any one of at least two directions. As a result, the rocking motion of the platen frame can be effected by the operator operating the operation portion in a direction allowing easy manipulation according to each attitude of the apparatus, thereby realizing extremely good operability. Such an improvement in operability due to this construction proves extremely effective particularly in small portable apparatuses which may be set at various positions or attitudes during use. The at least two directions may be two mutually orthogonal directions.

A thermal printer according to the present invention includes the platen moving mechanism of any one of the constructions described above, and the head is a thermal head for heating the sheet material. Further, a cutter unit may be fixed in position in a vicinity of a downstream side in the passage direction of the sheet material, the cutter unit including a slit into which the sheet material that has passed through a gap between the head and the platen is inserted, and a cutter member that cuts the sheet material inserted into the slit. In this case, the cutter member does not need to be exposed to the outside, and moreover the cutter member does not rock together with the platen frame, whereby there is no fear of damage to the operator.

According to the present invention, the platen can be separated away from the head to the outside of the casing through rocking motion of the platen frame, allowing easy maintenance, jam processing, etc. Further, the platen frame rocks in a direction different from the sheet material passage direction, thereby preventing the platen frame from moving toward the downstream side of the sheet material passage direction during its rocking motion. As a result, a component for performing another processing, such as cutting, on the sheet material immediately after it has undergone processing by the head can be arranged on the downstream side of the sheet material passage direction in close proximity to the head.

DETAILED DESCRIPTION OF THE PREFERRED EMBODIMENTS

Hereinbelow, an embodiment of the present invention is described with reference to the drawings.

Figure 1:
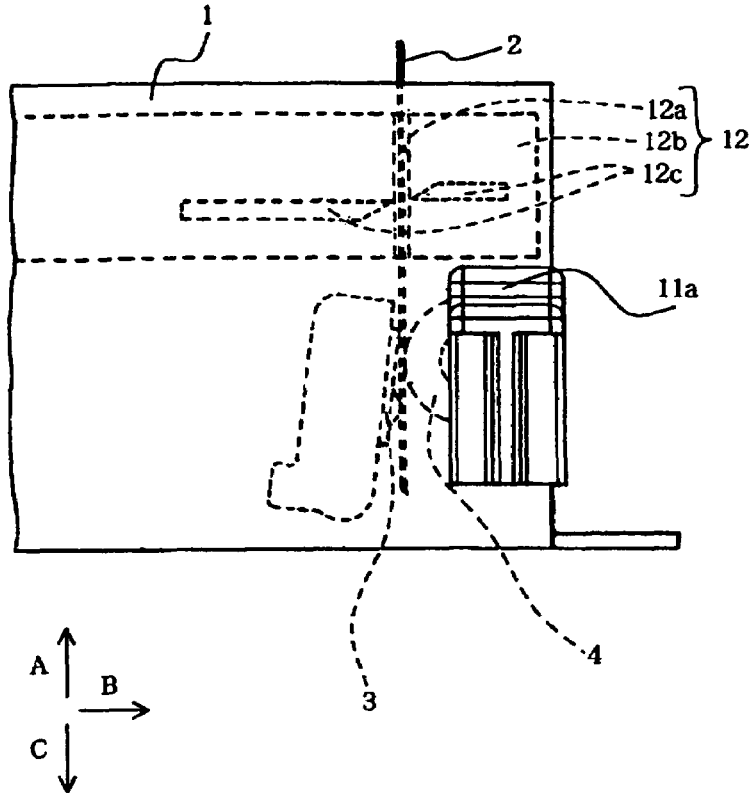
FIG. 1 is a schematic view showing a main portion of a thermal printer according to the present invention.

FIG. 1 schematically illustrates a main portion of a portable apparatus employing an embodiment of the present invention. The portable apparatus is a thermal printer having, inside a casing 1, at least a conveying mechanism for a sheet material 2 that is the material to be processed, and a thermal head 3 for heating the sheet material 2. Although not described in detail, the thermal head 3 has a number of heating elements arranged in matrix, and each heating element is independently actuated according to a supplied drive signal. A platen roller 4, which constitutes a part of the conveying mechanism and is opposed in close proximity to the thermal head 3, holds the sheet material 2 such that the sheet material 2 is in abutment with the thermal head 3. In this embodiment, the sheet material 2 is thermal recording paper. With the sheet material 2 abutting the thermal head 3 while supported and conveyed by the platen roller 4, as a predetermined heating element of the thermal head 3 is driven and generates heat, the location affected by the heat develops color, thereby effecting recording of letters, graphics, etc.

On the upper side in the drawing, that is, on the downstream side in the sheet material passage direction described later, a cutter unit 12 is fixed in close proximity to the thermal head 3 and the platen roller 4. The cutter unit 12 has a pair of opposing cutter members (edges) 12*c* provided inside a case 12*b* having a slit 12*a*. In the cutter unit 12, the cutter members 12*c* cut the sheet material 2 entering the slit 12*a* after passing through the gap between the thermal head 3 and the platen roller 4.

Figure 2:
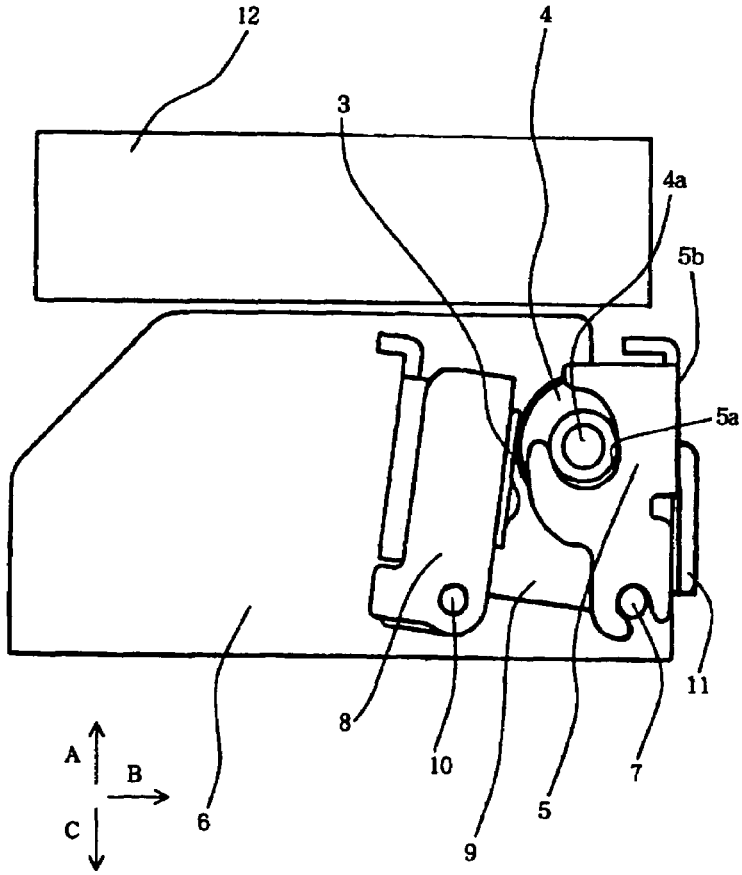
FIG. 2 is an internal structural view of the thermal printer shown in FIG. 1, illustrating a platen frame in a state in which the platen frame is closed.
Figure 3:
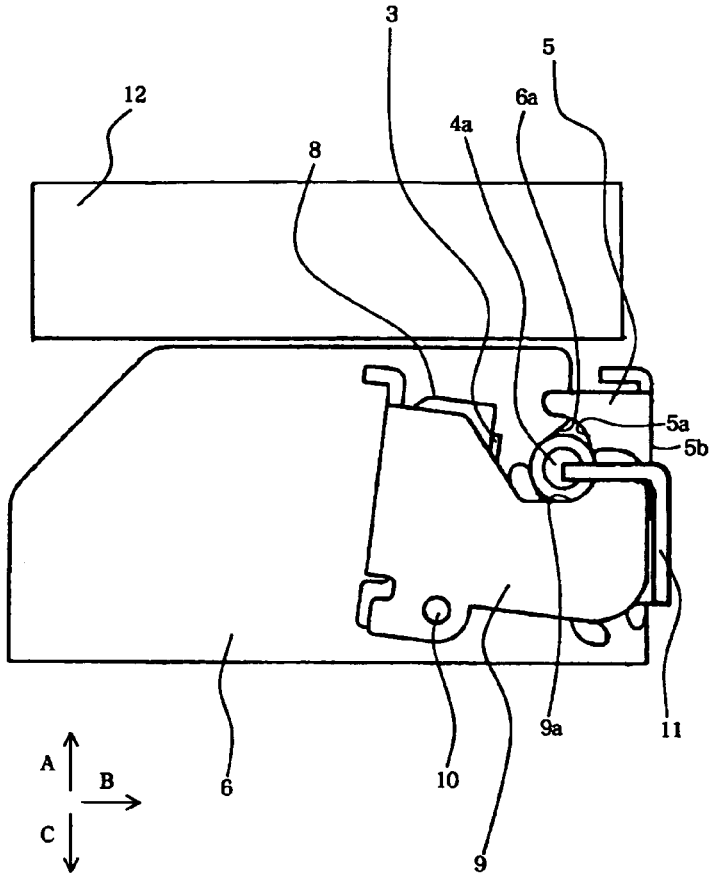
FIG. 3 is an internal structural view of the thermal printer shown in FIG. 1, illustrating a lock arm in the state in which the platen frame is closed.
Figure 4:
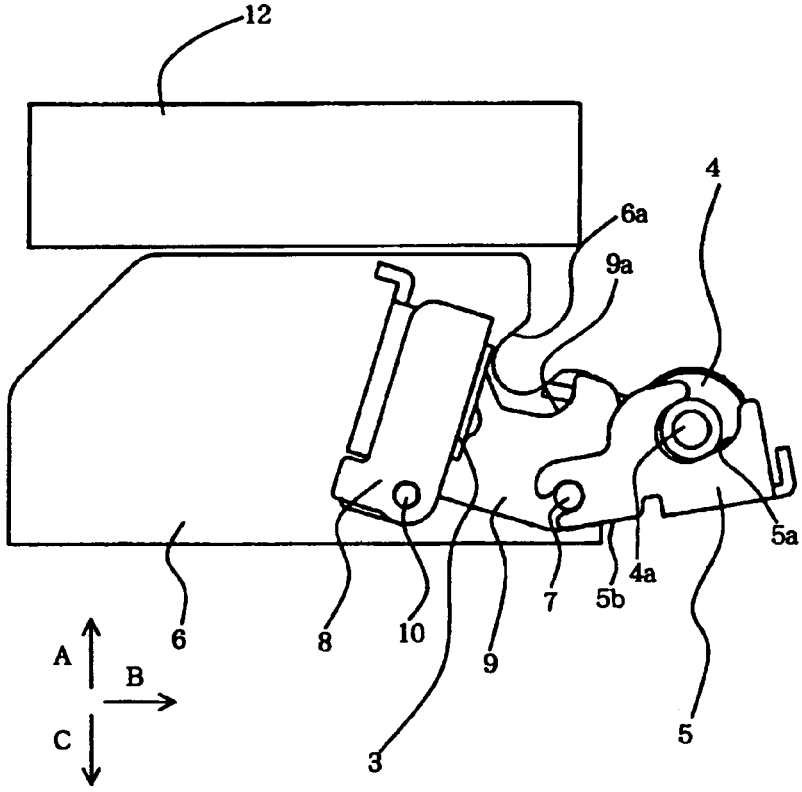
FIG. 4 is an internal structural view of the thermal printer shown in FIG. 1, illustrating the platen frame in a state in which the platen frame is opened.
Figure 5:
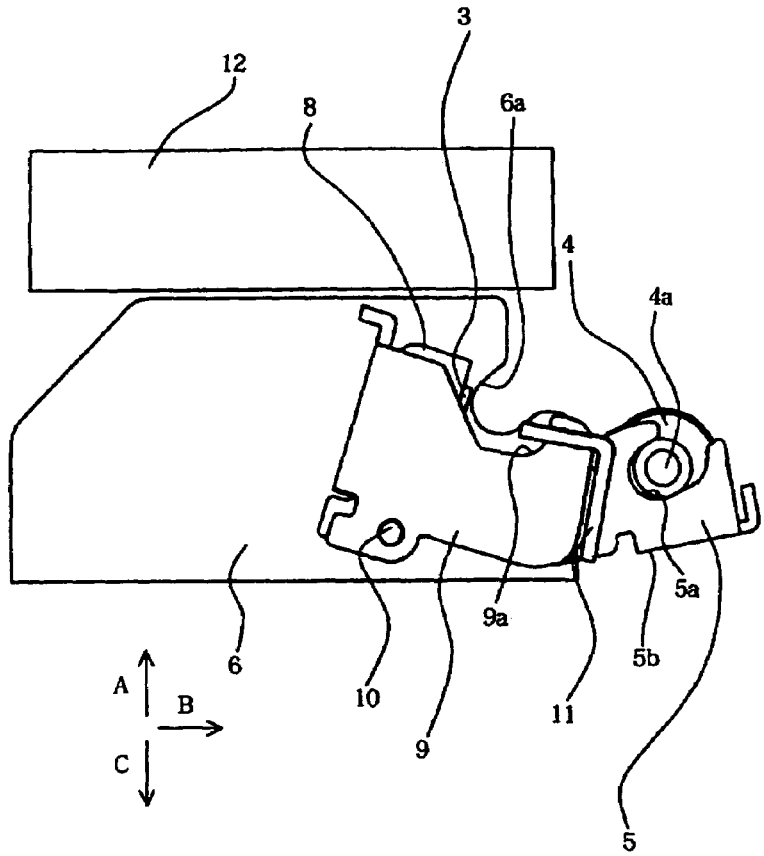
FIG. 5 is an internal structural view of the thermal printer shown in FIG. 1, illustrating the lock arm in the state in which the platen frame is opened.

As shown in FIGS. 2 through 5, a shaft portion 4*a* of the platen roller 4 is retained within a recess 5*a* of a platen frame 5. The platen frame 5 is mounted to a main body frame 6 inside the casing 1 so as to be openable and closable as it pivots or rocks about a first pivotal or rock shaft 7. With the platen frame 5 being closed so as to block the opening communicating with the inner portion of the casing, a principal surface Sb of the platen frame 5 forms a part of the outer wall of the casing 1. On the other hand, the thermal head 3 is fixed to a head support member 8, which in turn is mounted to a lock arm 9, with the head support member 8 and the lock arm 9 being capable of integrally rocking about a second pivotal or rock shaft 10. It is to be noted that FIGS. 2 and 3 each illustrate a state in which the platen frame 5 is closed, of which FIG. 2 shows a position allowing easy viewing of the platen frame 5, and FIG. 3 shows a position allowing easy viewing of the lock arm 9. On the other hand, FIGS. 4 and 5 each illustrate a state in which the platen frame 5 is opened, of which FIG. 4 shows a position allowing easy viewing of the platen frame 5, and FIG. 5 shows a position allowing easy viewing of the lock arm 9.

With the platen frame 5 closed, the principal surface 5*b* is substantially upright, that is, located substantially parallel to the direction (the arrow A direction) in which the sheet material passes between the thermal head 3 and the platen roller 4. The principal surface 5*b* thus constitutes a part of the outer wall of the casing 1. At this time, the platen roller 4 is held so as to be rotatable about the shaft 4*a*, with the shaft portion 4*a* being retained in the recess 5*a*, inserted in a recess 6*a* of the main body frame 6, and inserted in a recess 9*a* of the lock arm 9, that is, with the shaft portion 4*a* entering the three recesses 5*a*, 6*a*, and 9*a* so as to be undetachable (see FIG. 3). In this state, the outer periphery of the platen roller 4 abuts the thermal head 3 (see FIG. 2). The state as shown in FIGS. 2 and 3 is the state enabling actuation of the thermal printer. That is, as the sheet material 2 supplied from the lower side of the drawing is inserted into the gap between the thermal head 3 and the outer periphery of the platen roller 4, and a drive signal is supplied to the thermal head 3 from a drive circuit (not shown), the heating elements of the thermal head 3 are selectively activated at appropriate timing to generate heat, and in synchronism with this, the platen roller 4 rotates and conveys the sheet material 2 toward the upper side of the drawing. Recording is thus effected on the sheet material 2 as desired.

In this embodiment, the sheet material 2 is conveyed from the lower side to the upper side of the drawing. Accordingly, the upper side of the drawing is referred to as the downstream side, and the lower side of the drawing is referred to as the upstream side, with respect to the sheet material passage direction. It is to be noted that the advancing direction of the sheet material 2 before it enters the gap between the thermal head 3 and the platen roller 4 or after it exits the gap between the thermal head 3 and the platen roller 4 is not particular limited. While the advancing direction may be changed arbitrarily, throughout the description of this specification, the sheet material passage direction refers to the advancing direction of the sheet material 2 (the arrow A direction) as it passes through the gap between the thermal head 3 and the platen roller 4.

During non-actuation of the thermal printer, when performing maintenance on the thermal head 3 or the platen roller 4, when handling jamming of the sheet material 2 occurring due to a trouble or the like in the conveying mechanism (such as when removing the jammed sheet material 2), or when the sheet material 2 is to be set in position anew, the platen roller 4 is moved away from a position in close proximity to the platen roller 3. In this embodiment, as shown in FIGS. 4 and 5, as the platen frame 5 is pulled rightward in the drawing (arrow B direction), that is, frontward as seen from the operator, the platen frame 5 rocks about the rock shaft 7, thus forming an opening communicating with the interior of the casing, and the platen roller 4 moves away from the thermal head 3, thus securing a sufficient space in the thermal head 3 for the operator's hand to approach to perform work. The platen roller 4 is pulled to the outside of the casing 1 while retained in the recess 5*a* of the platen frame 5. The platen roller 4 dislodges from the recess 6*a* of the main body frame 6 as the platen frame 5 rocks. Further, the platen roller 4 also dislodges from the recess 9*a* of the lock arm 9 as the head support member 8 and the rock arm 9 rock as described later. Accordingly, the platen roller 4 can be completely removed from the recess 5*a* of the platen frame 5 to be carried to the outside of the casing 1 for repair, replacement, etc. In this embodiment, such rocking motion of the platen frame 5 is effected in synchronism with the rocking motions of the head support member 8 and lock arm 9 about the rock shaft 10. Although the head support member 8 and the lock arm 9 rock only slightly, as the lock arm 9 rocks, the recess 9*a* that has contributed to the fixing of the platen roller 4 separates from the platen roller 4, whereby the platen roller 4 is released, and as described above, can be pulled to the outside of the casing 1 while being supported by the platen frame 5. This state as shown in FIGS. 4 and 5 is the state allowing maintenance to be performed on the thermal printer.

To restore the thermal printer from the maintenance-enabling state to the operable state, the platen frame 5 that has been opened to the outside of the casing 1 is caused to rock leftward as seen in the drawing toward the inner portion of the casing 1. At this time, the head support member 8 and the lock arm 9 also rock in synchronism with this rocking motion, and the recess 9*a* of the lock arm 9 engages with the platen roller 4 at the end or immediately before the end of the rocking motion of the platen frame 5. The platen roller 4 is thus held in position with the shaft portion 4*a* being fitted into the recess 6*a* of the main body frame 6 and the recess 9*a* of the lock arm 9.

As described above, according to this embodiment, the platen roller 4 is moved away from the thermal head 3 through rocking motion of the platen frame 5, whereby the platen roller 4 can be pulled to the outside of the casing 1. This facilitates maintenance, jam processing, setting of the sheet material 2 in position, etc. In particular, in this embodiment, with the platen frame 5 closed, the principal surface 5*b* is substantially upright (located substantially parallel to the passage direction (arrow A direction) of the sheet material 2), and the rock shaft 7 for the platen frame 5 is located in the inner portion of the casing 1, that is, on the inner side of the casing 1 with respect to the substantially upright principal surface 5*b*. Further, the platen frame 5 is caused to rock through the operation of pulling it toward the outside of the casing 1 in the direction different from the sheet material passage direction, preferably in the direction substantially orthogonal to the sheet material passage direction (arrow B direction). Accordingly, the rocking path of the platen frame 5 is directed only toward the lower right of the drawing, that is, to the lower (upstream side in the sheet material passage direction) frontward side (outside of the casing) as seen from the operator. Therefore, the rocking path of the platen frame 5 is such that the platen frame 5 is not displaced upward, that is, to the downstream side in the sheet material passage direction. This enables various other components (the cutter unit 12 in this embodiment) to be arranged on the downstream side in the sheet material passage direction (upper side in the drawing) without interference with the rocking motion of the platen roller 4 for removing the same. As described above, in this embodiment, the rock shaft 7 is arranged at a position such that the platen frame 5 does not move toward the downstream side in the passage direction of the sheet material 2 as the platen frame 5 is opened.

To elaborate on this point, in conventional constructions, the platen roller is removed toward the downstream side in the sheet material passage direction from a position opposed in close proximity to the thermal head, or the platen roller 4 is moved to a position allowing its removable after the platen roller 4 is at least temporarily moved from the position opposed in close proximity to the thermal head 3 to the downstream side in the sheet material passage direction by at least part of components of the platen frame holding the platen roller or the like. Accordingly, some space must be provided on the downstream side of the sheet material passage direction so that the above movement of the platen roller is not obstructed, making it impossible to provide other components in very close proximity to the thermal head and the platen roller on the downstream side thereof. For example, it has been impossible to provide a cutter member on the downstream side of the thermal head and the platen roller so as to be in close proximity thereto. In this case, the sheet material cannot be cut immediately after its processing with the thermal head, with the result that wasteful consumption of the sheet material may occur until the sheet material reaches the cutter member after exiting the thermal head.

In contrast, as described above, according to this embodiment, other components can be arranged on the downstream side in close proximity to the thermal head 3 and the platen roller 4 without a fear of interference with the rocking motion of the platen frame 5 for removing the platen roller 4. In the example illustrated in the drawings, the cutter unit 12 is arranged on the downstream side in close proximity to the thermal head 3 and the platen roller 4 so that the sheet material 2 can be cut immediately after being processed with the thermal head 3, thus making it possible to cut the sheet material 2 at an arbitrary position to eliminate wasteful consumption of the same. Further, with this construction, the cutter member 12*c* is not exposed to the outside and does not rock together with the platen frame 5, whereby there is no fear of damage to the operator. The cutter unit 12 is held stationary and thus does not rock in synchronism with the platen frame 5 or the like. It is to be noted, however, that a construction may also be adopted in which the cutter unit 12 can be removed or moved through some separate mechanism independent from the platen frame 5 or the like.

Figure 6:
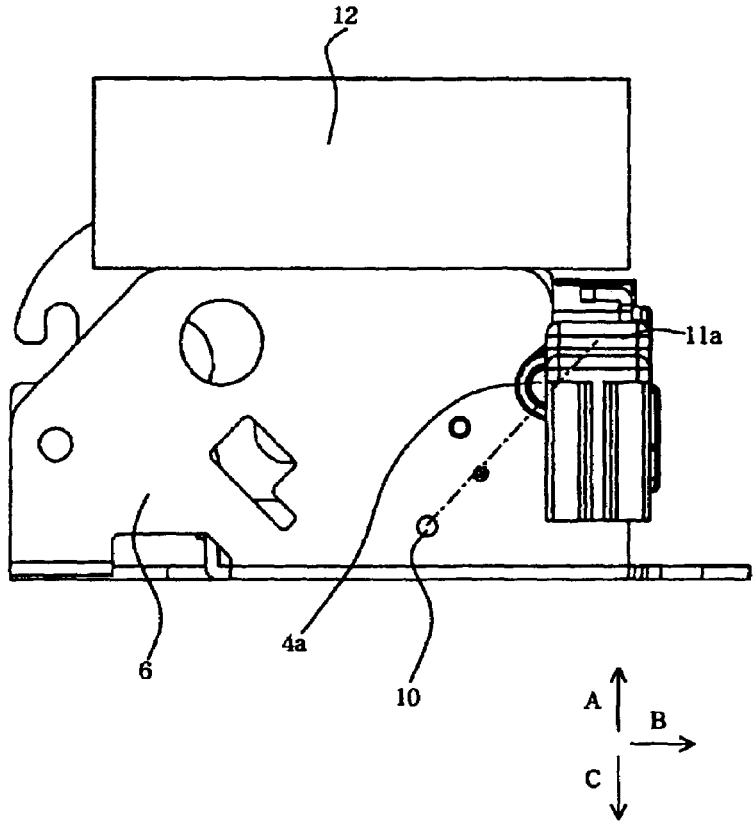
FIG. 6 is an internal structural view of the thermal printer shown in FIG. 1, illustrating an operation portion in the state in which the platen frame is closed.
Figure 7:
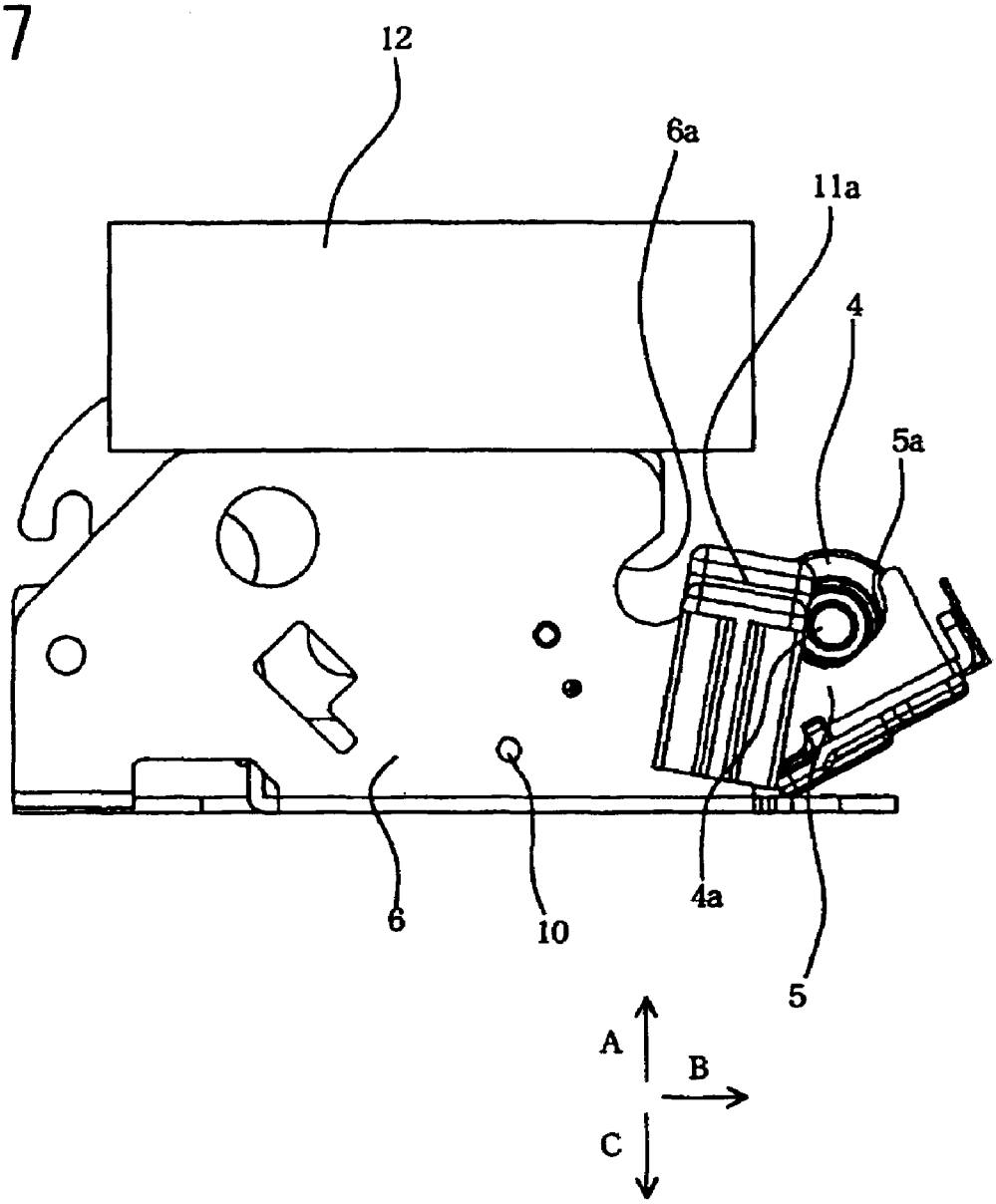
FIG. 7 is an internal structural view of the thermal printer shown in FIG. 1, illustrating the operation portion in the state in which the platen frame is opened.

Next, another characteristic feature of the present invention is described with reference to FIGS. 6 and 7. The above-described rocking motion of the platen frame 5 for removing the platen roller 4 is effected by the operator operating a switch lever 11. The switch lever 11 is mounted so as to move integrally with the lock arm 9. As the operator operates the switch lever 11, the lock arm 9 and the head support member 8 rock about the rock shaft 10, and in synchronism with this, the platen frame 5 rocks about the rock shaft 7. The switch lever 11 is provided in the vicinity of the outer wall of the casing 1, and has an operation portion 11*a* exposed to the exterior of the casing 1. With the platen frame 5 closed, the operation portion 11*a* is at a position (see the alternate long and short dash line of FIG. 6) where it is spaced away from the rocking shaft 10 toward the outside of the casing 1 and forms an angle of approximately 45 degrees with respect to the horizontal direction. Therefore, regardless of whether the operator pushes the operation portion 11*a* downward in the drawing (the arrow C direction) or the operator pulls the operation portion 11*a* frontward (rightward in the drawing: the arrow B direction), a force applied to the switch lever 11 acts in substantially the same direction as the direction of the rocking motion of the lock arm 9 about the rock shaft 10, thus making it possible to start the rocking motion of the lock arm 9 and the like. In other words, the operation by the operator for effecting rocking motion of the platen frame 5 to remove the platen roller 4 can be achieved by both pushing the operation portion 11*a* downward and by pulling it frontward. In this way, the same rocking motion of the platen frame 5 can be effected by operating the operation portion 11*a* in any one of two substantially mutually orthogonal directions (downward and frontward). Accordingly, in the case where the thermal printer is likely to be set in various attitudes during use, in particular, any one of the two directions can be freely chosen and the operator may simply operate the operation portion 11*a* in a direction allowing easy application of force according to each attitude, thereby realizing extremely good operability. As described above, it suffices that the operation portion 11*a* may be operated in at least two directions, particularly preferably in a plurality of directions including two mutually orthogonal directions.

It is to be noted that while the head used in this embodiment is the thermal head 3 for heating the sheet material 2 to effect recording or thermal activation, this should not be construed restrictively. The present invention is applicable to structures having all kinds of heads for performing various processing on the sheet material, such as an ink jet recording head. Further, the platen is not limited to the platen roller 4 as described above; a flat, non-rotatable platen may be used instead of a roller-shaped platen. Further, a conveyor roller (not shown) for conveying the sheet material may be separately provided. Further, the present invention may be adopted not only in thermal printers but in various apparatuses for processing the sheet material, and proves extremely effective when used in small portable apparatuses, in particular.

What is claimed is:

1. A platen moving mechanism comprising:

a casing;

a main body frame mounted on the casing, the main body frame having a first recess;

a head arranged inside the main body frame for performing processing on a sheet material;

a platen roller having a shaft portion that is inserted in the first recess of the main body frame and opposite to the head while the sheet material is fed in a preselected feeding direction between the platen roller and the head during processing of the sheet material by the head;

a platen frame for supporting the platen roller and mounted on the main body frame to undergo pivotal movement about a first pivotal shaft between an open state and a closed state to open and close, respectively, an opening communicating with an inner portion of the casing, the platen frame having a second recess that retains the shaft portion of the platen roller during processing of the sheet material by the head and from which the shaft portion can be completely removed in the open state of the platen frame for repair or replacement of the platen roller;

a lock arm mounted to undergo pivotal movement about a second pivotal shaft for supporting the platen roller in the closed state of the platen frame, the lock arm having a third recess in which the shaft portion of the platen roller is inserted in the closed state of the platen frame;

a head support member for supporting the head and mounted to undergo pivotal movement about the second pivotal shaft in synchronism with pivotal movement of the lock arm and the platen frame; and a switch lever mounted integrally with the lock arm for causing the platen frame to undergo pivotal movement about the first pivotal shaft in synchronism with pivotal movement of the lock arm and the head support member about the second pivotal shaft, the switch lever having an operation portion operable by an operator to undergo movement in any one of at least two directions to cause the platen frame to undergo pivotal movement about the first pivotal shaft;

wherein during the processing of the sheet material by the head, the platen frame remains in the closed state such that a main surface of the platen frame forms a part of an exterior wall of the casing and is oriented substantially parallel to the preselected feeding direction of the sheet material, and such that an outer periphery of the platen roller abuts the head while the platen roller is supported so as to be rotatable about the shaft portion thereof and while the shaft portion is securely retained in the second recess of the platen frame and inserted in the first recess of the main body frame and the third recess of the lock arm.

2. A platen moving mechanism according to claim 1; wherein the first pivotal shaft is positioned such that the platen frame does not move in the passage direction of the sheet material during movement of the platen frame to the open state.

3. A thermal printer comprising the platen moving mechanism according to claim 1; wherein the head comprises a thermal head for heating the sheet material.

4. A thermal printer according to claim 3; further comprising a cutter unit mounted at a position in a vicinity of a downstream side in the passage direction of the sheet material, the cutter unit comprising a slit into which the sheet material that has passed through a gap between the thermal head and the platen roller is inserted, and a cutter member that cuts the sheet material inserted into the slit.

5. A platen moving mechanism according to claim 1; wherein the at least two directions of the operation portion of the switch lever are two substantially mutually orthogonal directions.

6. A platen moving mechanism according to claim 1; wherein the head comprises a thermal head.

7. A thermal printer according to claim 1; wherein in a closed state of the platen frame, the operation portion of the switch lever is spaced from the second pivotal shaft and is disposed at an angle of approximately 45 degrees from a base surface of the casing.

8. A platen moving mechanism according to claim 1; wherein in the closed state of the platen frame, the shaft portion of the platen roller is retained in the second recess of the platen frame and is inserted in the first recess of the main body frame and in the third recess of the lock arm such that the sheet material is discharged substantially parallel to the main surface of the of the platen frame.

9. A platen moving mechanism according to claim 1; wherein as the platen frame is pivoted to the open state, the platen frame pivots in a direction different from a passage direction of the sheet material such that the platen frame is drawn out to an outside of the casing and does not move toward a downstream side of the passage direction.

10. A platen moving mechanism comprising:

a casing;

a main body frame mounted on the casing, the main body frame having a first recess;

a head arranged inside the main body frame for performing processing on a sheet material;

a platen roller having a shaft portion that is inserted in the first recess of the main body frame and opposite to the head while the sheet material is fed in a preselected feeding direction between the platen roller and the head during processing of the sheet material by the head;

a platen frame for supporting the platen roller and mounted on the main body frame to undergo pivotal movement about a first pivotal shaft between an open state and a closed state to open and close, respectively, an opening communicating with an inner portion of the casing, the platen frame having a second recess that retains the shaft portion of the platen roller during processing of the sheet material by the head and from which the shaft portion can be completely removed in the open state of the platen frame for repair or replacement of the platen roller;

a lock arm mounted to undergo pivotal movement about a second pivotal shaft for supporting the platen roller in the closed state of the platen frame, the lock arm having a third recess in which the shaft portion of the platen roller is inserted in the closed state of the platen frame;

a head support member for supporting the head and mounted to undergo pivotal movement about the second pivotal shaft in synchronism with pivotal movement of the lock arm and the platen frame; and a switch lever mounted integrally with the lock arm and having an operation portion operable by an operator to undergo movement in any one of at least two different directions to cause the lock arm to pivot about the second pivotal shaft so that the platen frame undergoes pivotal movement about the first pivotal shaft in synchronism with pivotal movement of the lock arm and the head support member about the second pivotal shaft.

11. A platen moving mechanism according to claim 10; wherein during the processing of the sheet material by the head, the platen frame remains in the closed state such that a main surface of the platen frame forms a part of an exterior wall of the casing and is oriented substantially parallel to the preselected feeding direction of the sheet material, and such that an outer periphery of the platen roller abuts the head while the platen roller is supported so as to be rotatable about the shaft portion thereof and while the shaft portion is securely retained in the second recess of the platen frame and inserted in the first recess of the main body frame and the third recess of the lock arm.

12. A platen moving mechanism according to claim 11; wherein as the platen frame is pivoted to the open state, the platen frame pivots in a direction different from a passage direction of the sheet material such that the platen frame is drawn out to an outside of the casing; and wherein the first pivotal shaft is positioned such that the platen frame does not move in the passage direction of the sheet material during movement of the platen frame to the opened state.

13. A platen moving mechanism according to claim 10; wherein the at least two directions of the operation portion of the switch lever are two substantially mutually orthogonal directions.

14. A platen moving mechanism according to claim 10; wherein the head comprises a thermal head.

15. A platen moving mechanism according to claim 10; wherein the sheet material comprises a recording medium; and wherein the head comprises a thermal head for printing on the recording medium.

16. A thermal printer comprising the platen moving mechanism according to claim 10; wherein the head comprises a thermal head for heating the sheet material.

17. A thermal printer according to claim 16; further comprising a cutter unit mounted at a position in a vicinity of a downstream side in the passage direction of the sheet material, the cutter unit comprising a slit into which the sheet material that has passed through a gap between the head and the platen is inserted, and a cutter member that cuts the sheet material inserted into the slit.

18. A thermal printer according to claim 16; wherein the sheet material comprises a recording medium; and wherein the head comprises a thermal head for printing on the recording medium.

19. A thermal printer according to claim 10; wherein in a closed state of the platen frame, the operation portion of the switch lever is spaced from the second pivotal shaft and is disposed at an angle of approximately 45 degrees from a base surface of the casing.

20. A platen moving mechanism comprising:

a casing;

a main body frame mounted on the casing, the main body frame having a first recess;

a head arranged inside the main body frame for performing processing on a sheet material;

a platen roller having a shaft portion that is inserted in the first recess of the main body frame and opposite to the head while the sheet material is fed in a preselected feeding direction between the platen roller and the head during processing of the sheet material by the head;

a platen frame for supporting the platen roller and mounted on the main body frame to undergo pivotal movement about a first pivotal shaft between an open state and a closed state to open and close, respectively, an opening communicating with an inner portion of the casing, the platen frame having a second recess that retains the shaft portion of the platen roller during processing of the sheet material by the head and from which the shaft portion can be completely removed in the open state of the platen frame for repair or replacement of the platen roller;

a lock arm mounted to undergo pivotal movement about a second pivotal shaft for supporting the platen roller in the closed state of the platen frame, the lock arm having a third recess in which the shaft portion of the platen roller is inserted in the closed state of the platen frame;

a head support member for supporting the head and mounted to undergo pivotal movement about the second pivotal shaft in synchronism with pivotal movement of the lock arm and the platen frame; and a switch lever mounted integrally with the lock arm for causing the platen frame to undergo pivotal movement about the first pivotal shaft in synchronism with pivotal movement of the lock arm and the head support member about the second pivotal shaft, the switch lever having an operation portion operable by an operator to undergo movement in any one of at least two directions to cause the platen frame to undergo pivotal movement about the first pivotal shaft;

wherein during the processing of the sheet material by the head, the platen frame remains in the closed state such that a main surface of the platen frame forms a part of an exterior wall of the casing and is oriented substantially parallel to the preselected feeding direction of the sheet material, and such that an outer periphery of the platen roller abuts the head while the platen roller is supported so as to be rotatable about the shaft portion thereof and while the shaft portion is securely retained in the second recess of the platen frame and inserted in the first recess of the main body frame and the third recess of the lock arm; and wherein the platen frame undergoes pivotal movement about the first pivotal shaft from the closed state to the open state so as to open the opening communicating with the inner portion of the casing while the shaft portion of the platen roller is retained in the second recess of the platen frame and is dislodged from the first recess of the main body frame and the third recess of the lock arm to thereby permit complete removal of the platen roller from the second recess of the platen frame in the open state of the platen frame.

21. A platen moving mechanism according to claim 20; wherein in the closed state of the platen frame, the shaft portion of the platen roller is retained in the second recess of the platen frame and is inserted in the first recess of the main body frame and in the third recess of the lock arm such that the sheet material is discharged substantially parallel to the main surface of the of the platen frame; and wherein as the platen frame is pivoted to the open state, the platen frame pivots in a direction different from a passage direction of the sheet material such that the platen frame is drawn out to an outside of the casing and does not move toward a downstream side of the passage direction.

22. A thermal printer comprising: a platen moving mechanism according to claim 20, the head of the platen moving mechanism comprising a thermal head for heating the sheet material; and a cutter unit mounted at a position in a vicinity of a downstream side in the passage direction of the sheet material, the cutter unit comprising a slit into which the sheet material that has passed through a gap between the thermal head and the platen roller is inserted, and a cutter member that cuts the sheet material inserted into the slit.

* * * * *